United States Patent [19]

Remery

[11] 4,177,403

[45] Dec. 4, 1979

[54] ELECTRONIC STARTER FOR IGNITING A DISCHARGE LAMP

[75] Inventor: Michel Remery, Evreux, France

[73] Assignee: U.S. Philips Corporation, New York, N.Y.

[21] Appl. No.: 870,026

[22] Filed: Jan. 16, 1978

[30] Foreign Application Priority Data

Jan. 31, 1977 [FR] France ..... 77 02585

[51] Int. Cl.[2] ..... H05B 41/16; H05B 41/04

[52] U.S. Cl. ..... 315/101; 315/106; 315/207; 315/309

[58] Field of Search ..... 315/99, 101, 105, 106, 315/107, 119, 207, 309, DIG. 5

[56] References Cited

U.S. PATENT DOCUMENTS

| | | | |
|---|---|---|---|
| 3,875,459 | 4/1975 | Remery et al. | 315/105 X |
| 3,978,368 | 8/1976 | Tomura et al. | 315/101 X |
| 3,978,369 | 8/1976 | Imaizumi et al. | 315/101 X |

FOREIGN PATENT DOCUMENTS

| | | | |
|---|---|---|---|
| 2255777 | 7/1975 | France | 315/106 |
| 2285780 | 4/1976 | France | 315/101 |

*Primary Examiner*—Eugene R. La Roche

*Attorney, Agent, or Firm*—Thomas A. Briody; William J. Streeter; Bernard Franzblau

[57] ABSTRACT

An electronic starter for a discharge lamp includes an SCR controlled by a temperature-sensitive element and an auxiliary switch arranged so that no current flows in the temperature-sensitive element when the lamp is in operation, whereby rapid restarting of the lamp occurs after a brief interruption of the AC supply voltage. The temperature-sensitive element may be thermally coupled to an inductor in series with the lamp ballast thereby to limit the ballast current in the event the lamp fails to ignite.

19 Claims, 10 Drawing Figures

ELECTRONIC STARTER FOR IGNITING A DISCHARGE LAMP

The invention relates to an electronic starter for igniting a discharge lamp, the starter having two input terminals which are interconnected by an electric circuit comprising at least a controlled semiconductor switch. The starter further comprises a control circuit for controlling said semiconductor switch, said control circuit comprising a temperature-sensitive circuit element which inhibits the igniting function of the starter at elevated temperatures. The invention also relates to an electric circuit comprising a gas and/or vapour discharge lamp as well as an electronic starter of the type mentioned in the preamble, which starter is used for igniting the lamp.

It may happen that a discharge lamp refuses to ignite, for example owing to ageing. Such a situation should not result in an excessive electric current in the stabilisation ballast arranged in series with the lamp because this might damage that ballast or might even cause a fire.

It is therefore desirable to inhibit the operation of the starter if the relevant lamp does not ignite within a few seconds after the circuit has been energized.

French Patent Application No. 2,279,302 describes a lamp circuit comprising an electronic starter of the type mentioned in the preamble wherein the above-mentioned protection is obtained by means of a resistor having a negative temperature coefficient (NTC). In an embodiment of that French Patent Application this resistor is arranged in parallel with a capacitor which is a part of the control circuit of the semiconductor switch of the starter.

A drawback of that prior art electronic starter is that, in the operating condition of the lamp, an electric current flows continuously through the NTC resistor so that it is difficult, and sometimes even impossible, after a brief interruption of the power supply voltage, to ignite the lamp again after it has extinguished.

A second drawback of the above-mentioned prior art electronic starter is that an accidental interruption of the NTC resistor makes the protection of the ballast inoperative in the case of a lamp which fails to ignite.

It is an object of the invention to provide an electronic starter of the type mentioned in the preamble by means of which the discharge lamp to be ignited by it can rapidly re-ignite even after a short interruption of the supply voltage.

In addition it is an object of the invention to provide certain classes of electronic starters of the type mentioned in the preamble which not only obviate the first-mentioned drawback but also the second drawback. That is to say that certain defects in the temperature-sensitive circuit component do not result in damage to the lighting device to which said starter is connected. This means that an interruption in the temperature-sensitive circuit component or an accidental short-circuit thereof will not result in an excessive electric current through the stabilisation ballast of the lamp.

An electronic starter according to the invention for igniting a discharge lamp has two input terminals which are interconnected by an electric circuit comprising at least a controlled semiconductor switch. The starter further comprises a control circuit controlling said semiconductor switch which includes a temperature-sensitive circuit element which inhibits the igniting function of the starter at an elevated temperature. This electronic starter is characterized in that the control circuit of the controlled semiconductor switch comprises an auxiliary switch which is connected to the temperature-sensitive circuit element, the auxiliary switch being controlled by a threshold voltage element so that the auxiliary switch is open if the voltage across the threshold voltage element is lower than its threshold voltage.

An advantage of this electronic starter is that, after a very brief interruption in the supply voltage, the relevant discharge-lamp after extinguishing can again ignite reliably. This is the result of the fact that the temperature-sensitive circuit element carries no current in the operating condition of the lamp. The temperature of that temperature-sensitive circuit element can consequently be sufficiently low—after a very brief interruption in the supply voltage has ended—to enable re-ignition of the lamp.

The threshold voltage component is preferably a zener diode. In addition, it is advantageous for the temperature-sensitive circuit element to be thermally coupled to one of the starter components in which the current which flows also passes through the stabilisation ballast. As a result thereof, the ballast current can be kept low in the case of a failing lamp.

In a further preferred embodiment of an electronic starter according to the invention a further resistor is present in parallel with the circuit which includes the semiconductor switch, and the temperature-sensitive circuit element is thermally coupled to that additional resistor. An advantage thereof is that the ballast current—in the case of a failing lamp—can also be kept low.

In the two last-mentioned embodiments the temperature-sensitive circuit element is not only heated by the electric current flowing through the temperature-sensitive circuit element itself, but it is also heated by means of the current through a starter component which is thermally coupled to the temperature-sensitive circuit element.

Electronic starters according to the present invention may reduce—in the case of a failing lamp—the ballast current to a harmlessly low value. This value need not be equal to zero. Owing to a suitable temperature increase of the temperature-sensitive circuit element which is present in the control circuit of the controlled semiconductor switch, it can be ensured that the controlled semiconductor switch—which then carries the ballast current—is only occasionally conductive. Then the ballast current assumes, after an initial high value, a low final value.

Some embodiments of electronic starters according to the invention will now be described with reference to the accompanying drawings, in which.

Figure 1:
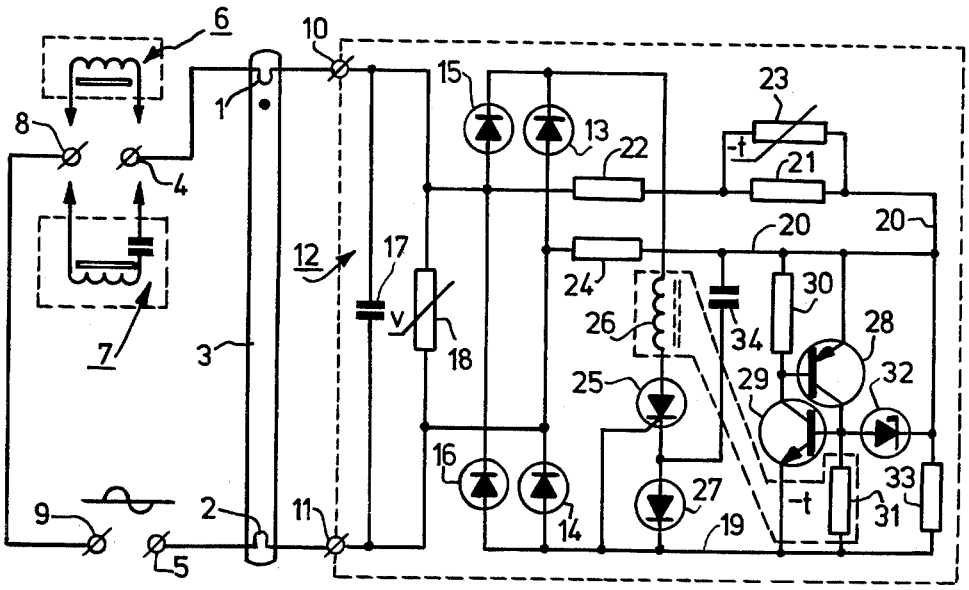
FIG. 1 shows a first electric circuit comprising a discharge lamp and an electronic starter according to the invention.

In FIG. 1 reference numerals 1 and 2 denote preheatable electrodes of a low-pressure mercury vapour discharge lamp 3. The electrode 1 is connected to a terminal 4. The electrode 2 is connected to a terminal 5 of an a.c. voltage supply of, for example, 220 volts, 50 Hz.

Connected to the terminal 4 there is a stabilisation ballast which is either inductive (ballast 6) or consists of a series arrangement of an electric coil and a capacitor, which series arrangement (ballast 7) is capacitive at the above-mentioned supply frequency. The other end of the relevant ballast is connected to a terminal 8 which in turn is connected to a second terminal 9 of the a.c. voltage supply.

The two ends of the electrodes 1 and 2 of the lamp 3 remote from the supply voltage are connected to input terminals 10 and 11 respectively of an electronic starter 12. The starter 12 serves for igniting the lamp 3. A diode bridge 13 to 16 inclusive is connected to the terminals 10 and 11. In addition, the terminals 10 and 11 are interconnected via a capacitor 17 and a temperature-sensitive auxiliary resistor 18.

The interconnected anodes of the diodes 14 and 16 are connected to a common conductor 19 (negative conductor).

A conductor 20 (positive conductor) is connected via a series arrangement of two resistors 22 and 21 to the terminal 10. The resistor 21 is shunted by a resistor 23 having a negative temperature coefficient. The conductor 20 is connected to the terminal 11 via a resistor 24.

Via an inductance 26 the anode of a thyristor 25 is connected to the interconnected cathodes of the diodes 13 and 15. The cathode of this thyristor 25 is connected to the anode of a diode 27 whose cathode is connected to the negative conductor 19. A control electrode of the thyristor 25 is also connected to the conductor 19.

The emitter of a pnp-transistor 28 is connected to the conductor 20 and the emitter of an npn-transistor 29 is connected to the conductor 19. The base of the transistor 28 is connected to the collector of the transistor 29, and the base of the transistor 29 is connected to the collector of the transistor 28. Furthermore, the base of the transistor 28 is connected via a resistor 30 to the conductor 20. In addition, the base of the transistor 29 is connected via a resistor 31, which has a negative temperature coefficient, to the conductor 19. The resistor 31 is thermally coupled to the inductance 26.

The cathode of a zener diode 32 is connected to the conductor 20 and its anode is connected to the base of the transistor 29. A resistor 33 is connected between the conductors 20 and 19. The conductor 20 is connected via a capacitor 34 to the cathode of the thyristor 25.

Figure 2:
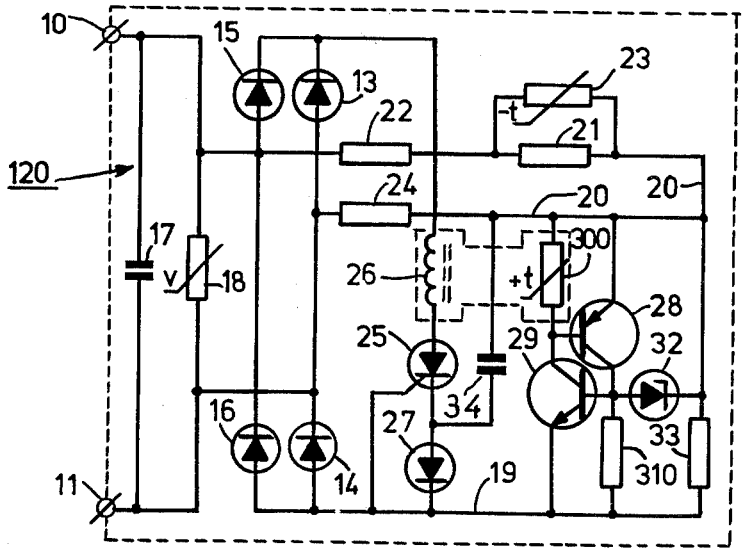
FIG. 2 shows an electric circuit of a second electronic starter according to the invention.

FIG. 2 shows an electric circuit of a second electronic starter 120 whose input terminals 10 and 11 are connected to electrodes 1 and 2 of a lamp 3 (not shown) in a similar manner to that shown in FIG. 1. The components in FIG. 2 which are the same as in FIG. 1 have been given the same reference numerals. However, the temperature-sensitive resistor 31 of FIG. 1 is replaced by a fixed resistor 310, whereas resistor 30 is replaced by a resistor 300 having a positive temperature coefficient. In addition, the resistor 300 is thermally coupled to the inductance 26.

The igniting pulses which are supplied by means of the starters 12 and 120 of FIGS. 1 and 2 resemble the igniting pulses which can be obtained with a starter according to the previously mentioned French Patent Application No. 2,279,302.

The intensity of the hold current (IH) of the thyristor 25 is increased by the provision of diode 27. Via its cathode this thyristor 25 is made conductive by negative pulses which are supplied by discharges of the capacitor 34, which capacitor is charged via the input terminals 10 and 11.

The use of thyristor 25, having an (apparently) large hold current, in series with inductance 26 causes the ballast circuit to be alternately conducting and interrupted at a very high frequency and hence promotes ignition of the lamp. The electric asymmetry of the described starter furthermore results in a direct current component in the current through the stabilisation ballast, which is advantageous because this increases the pre-heating current of the lamp electrodes 1 and 2 owing to magnetic saturation of the inductance of the ballast. This is of course only the case during the starting procedure; not during the operating condition of the lamp.

The starters 12 and 120, of the FIGS. 1 and 2, operate as follows:

Initially the voltage between the conductors 19 and 20 is equal to zero, capacitor 34 is uncharged, and the semiconductor device comprising transistors 28 and 29 is cut off. If the voltage between the terminals 10 and 11 is increased, the capacitor 34 is charged until the voltage between the conductors 19 and 20 attains the threshold voltage of the zener diode 32. The diode 32 then becomes conductive and this results in a current through the base of the transistor 29, which becomes conductive as a result thereof. In its turn this renders the transistor 28 conductive.

As this process is cumulative the two transistors are brought in a very short period of time into the saturation state, which results in a rapid partial discharge of the capacitor 34 so that indirectly a control pulse is supplied to the control electrode of the thyristor 25.

The above procedure repeats itself very frequently during a fraction of a half cycle of the AC voltage supply to render the thyristor conductive. The same occurs thereafter in the next half cycle but in a somewhat asymmetrical manner.

The starters 12 and 120 shown in FIGS. 1 and 2 respectively are electrically arranged so that an interruption or accidental short-circuiting of the temperature-sensitive resistor 31 or 300 of these starters does not result in an excessive current through the stabilisation ballast (6 or 7). For example, if PTC resistor 300 (FIG. 2) is short-circuited, a zero potential difference appears across first and second electrodes of the semiconductor device comprising transistors 28 and 29, i.e. between the emitter and base electrodes of transistor 28, which is then cut-off. However, transistor 29 will conduct to a certain extent as a result of a current through Zener diode 32, thereby counteracting the triggering of thyristor 25 so as to reduce the current through the stabilization ballast.

In the case of a normally-igniting lamp, the operation of the starter is immediately blocked after ignition of the lamp 3. This is caused by the fact that the voltage between the input terminals 10 and 11 decreases to the operating voltage of the lamp. Consequently the threshold voltage of the zener diode 32 is not attained. As a result, the temperature-sensitive resistor 31—in the operating condition of the lamp 3—receives no further current. Therefore, this temperature-sensitive resistor assumes a temperature which is substantially the same as the ambient temperature. After a very brief interruption of the supply voltage the resistor 31, which is then cold, does not inhibit—after extinction—the re-ignition of the lamp 3. The same applies in a corresponding manner to the further embodiments of electronic starters described hereinafter.

If the lamp 3 fails to ignite, the conducting state of the thyristor 25 results in that the ballast current then comprises a direct current component which causes a reduction of the effective impedance of the inductance of the ballast. The temperature of the ballast might then become higher than the temperature prescribed for safety reasons. However, the starters 12 and 120 are arranged so that they limit heating of the ballast to a temperature which is perfectly safe.

As regards the starter 12 of FIG. 1, reducing the value of the negative temperature coefficient (NTC) resistor 31 after heating thereof results in that the transistor 29 approaches its non-conductive state, which results in a delay in the discharge of the capacitor 34 at the beginning of each half cycle.

As regards the starter 120 of FIG. 2, the increasing value of the positive temperature coefficient (PTC) resistor 300 results in that the collector current of the transistor 29, and consequently also the base current of the transistor 28, then decreases, which also results in a delay in generating a control pulse by means of the capacitor 34.

Figure 3:
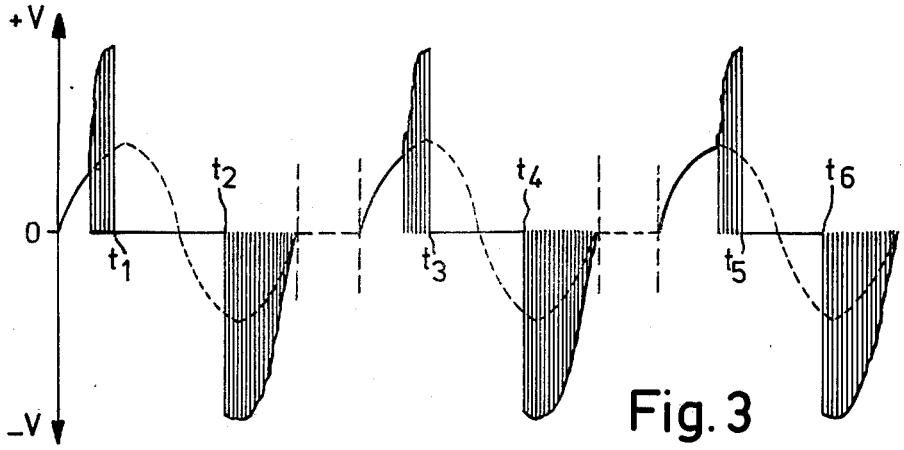
FIG. 3 shows schematically the waveform of the electric voltage between the input terminals of the starter, plotted against time, in the circuits of FIG. 1 and FIG. 2, if the discharge lamp does not immediately ignite.

FIG. 3 which, inter alia, shows the variation of the voltage between the electrodes of the lamp 3 in the case of an inductive ballast 6, shows the shift in the ignition instant in the positive half cycles during heating of the NTC resistor 31 or of the PTC resistor 300.

Consequently FIG. 3 shows that the duration of the time interval (t1–t2, t3–t4 and t5–t6) during which the thyristor 25 conducts has considerably decreased. This results in a reduction of the effective ballast current, the intensity of which stabilizes at a value which is safe for that ballast.

For the starters 12 and 120 of FIGS. 1 and 2, such safety is ensured that this applies even if the temperature-sensitive resistors 31, 300 are short-circuited or are open-circuited due to a fault in either of them.

In the case where resistor 31 or 300 is short-circuited, the transistors 28 and 29 cannot become conductive so that the thyristor 25 cannot become conductive. Substantially no current then flows through the ballast.

In the case where the NTC resistor 31 is open circuit, the intensity of the current received via the zener diode 32 is sufficient to keep the transistor 29 conductive, whereas in the case where the PTC resistor 300 is open the transistor 28 is also rendered conductive.

Figure 4:
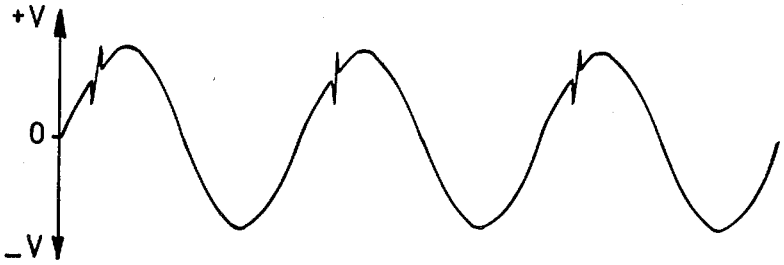
FIG. 4 shows schematically the waveform of the electric voltage between the input terminals of the starter, plotted against time, in the circuits of FIG. 1 and FIG. 2, if a temperature-sensitive circuit element in that starter is defective.

In these fault conditions a single pulse of a weak amplitude (FIG. 4) is observed during each positive half cycle. That pulse is due to a single discharge of the capacitor 34 via the conducting transistors 28 and 29. Consequently the high frequency oscillation process does not continue. Also in this case there is substantially no current flow through the stabilisation ballast of the lamp; i.e. a safe condition is established.

In certain circumstances it may be advantageous to reduce the intensity of the ballast current, in the case of a failing lamp, for example, to a negligibly low value, particularly, in the case where all the lamps of a large lighting installation are replaced at substantially the same time and hence tend to fail at the same time. Otherwise the total intensity of the ballast currents of the simultaneously failing lamps would result in a considerable waste of energy.

Figure 5:
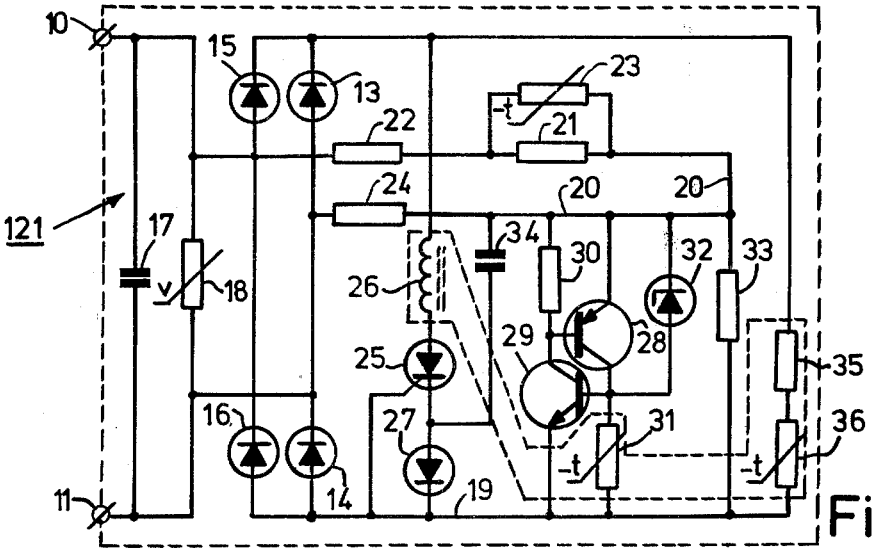
FIG. 5 shows an electric circuit of a third electronic starter according to the invention.

The starter 121 shown in FIG. 5, which also enables a reduction in the ballast current, comprises a series arrangement of a resistor 35 and a negative temperature coefficient (NTC) resistor 36 between the interconnected cathodes of the diodes 13, 15 and the conductor 19.

If the lamp does not ignite, the voltage across the series arrangement 35, 36 remains high. This results in an increase in temperature of these two resistors. Owing to the thermal coupling to the negative temperature coefficient resistor 31 the ohmic value of the latter decreases considerably, so that the transistor 29 as well as the thyristor 25 become non-conducting. The strength of the current which then flows between the terminals 10 and 11 of the starter is substantially reduced to the sum of the current through the zener diode 32 and the current through the resistors 35 and 36, that is to say, as a rule, to a few milliamperes.

It would also be possible to obtain the same final result, i.e. reducing the ballast current substantially to zero, by providing thermal coupling of the temperature-sensitive resistors 31 and 36 only. However, it is often desired also to maintain the thermal coupling to the inductance 26. This results in that the reduction of the current is accelerated by a pronounced increase in the temperature of the NTC resistor 31.

Figure 6:
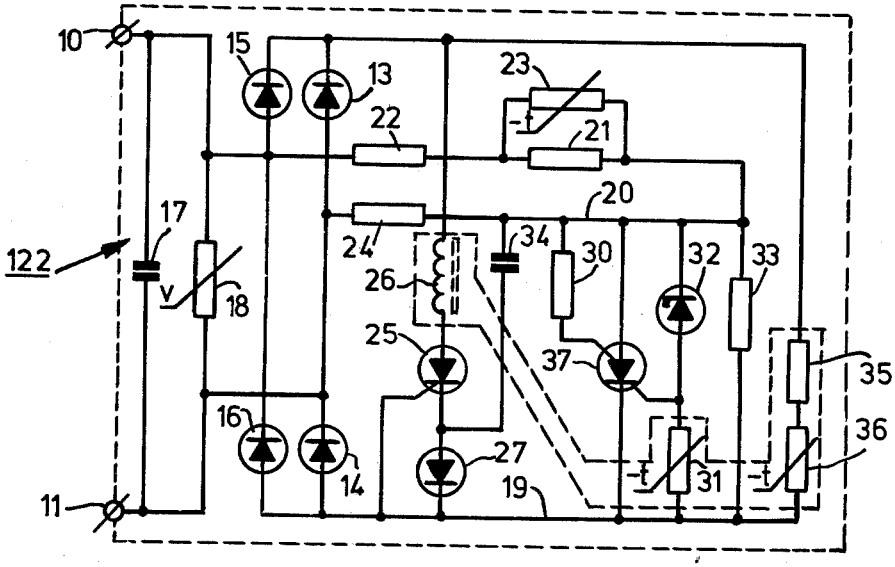
FIG. 6 shows an electric circuit of a fourth electronic starter according to the invention.

The starter 122 of FIG. 6, in which the same reference numerals are used as in FIGS. 1, 2 and 5, comprises, by way of switching arrangement, a tetrode thyristor 37, a control electrode of which is connected to the conductor 20 via a resistor 30. A further control electrode of thyristor 37 is connected to a junction between the anode of the zener diode 32 and the resistor 31.

The thyristor 37 of FIG. 6 switches in a similar manner to the combination formed by the transistors 28 and 29 of FIGS. 1, 2 and 5.

Figure 7:
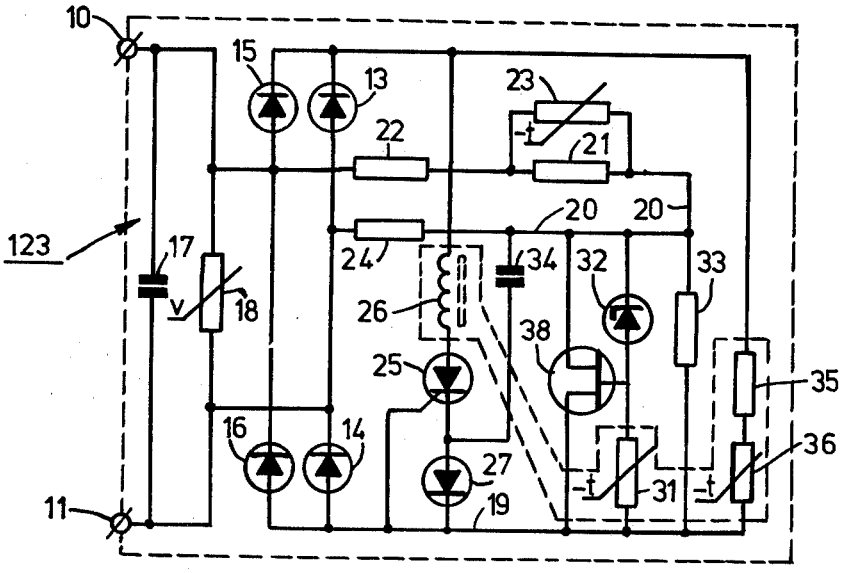
FIG. 7 shows an electric circuit of a fifth electronic starter according to the invention.
Figure 8:
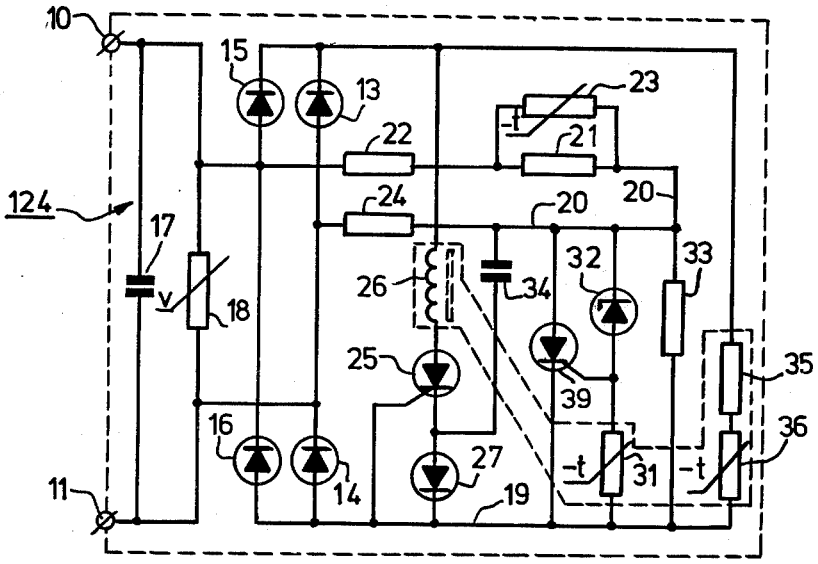
FIG. 8 shows an electric circuit of a sixth electronic starter according to the invention.

In FIG. 7 a unijunction transistor 38 is used as the auxiliary switch of the starter 123. In the starter circuit 124 of FIG. 8 a thyristor 39 is used for the same purpose.

Contrary to the starters described above, the starters 123 and 124 are not suitable for the embodiment in which a resistor having a positive temperature coefficient is used owing to the fact that the auxiliary switch comprises one control electrode only. But for this restriction the starters 123 and 124 of FIG. 7 and FIG. 8 respectively are fully comparable to the starters 12, 120, 121 and 122.

Figure 9:
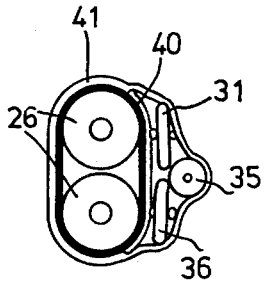
FIG. 9 shows a cross-section through a portion of the electronic starter of FIG. 5.
Figure 10:
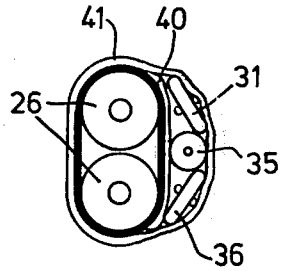
FIG. 10 shows a variant of the cross-section of FIG. 9 of an electronic starter.

FIGS. 9 and 10 show two embodiments for effecting the thermal coupling of the various components of the starter 121 of FIG. 5.

The inductance 26 of FIG. 9 and FIG. 10 consists of a double cylindrical ferrite core wound with wire. An electrically insulating film 40 is present between the inductance 26 and the resistors 31, 35 and 36. The assembly thus formed is clamped together by means of an envelope 41 of a resilient synthetic resin material.

The diameter of the electric wire of the inductance 26 is sufficiently small to ensure rapid heating of the inductance if the lamp fails to ignite.

The NTC resistor 23 (see FIGS. 1, 2, 5, 6, 7 and 8) serves inter alia to prevent the thyristor 25 from becoming conductive after the ignition of the lamp 3 over the entire range of ambient temperatures in which the starter should function.

What is claimed is:

1. An electronic starter for igniting a discharge lamp comprising, two input terminals adapted for connection to the lamp electrodes and interconnected by an electric circuit comprising at least a controlled semiconductor switch having first and second main electrodes defining a main current path through the switch and a control electrode for controlling the current flow in said main current path, a control circuit coupled between said control electrode and said first main electrode for controlling the operation of said semiconductor switch, said control circuit comprising a temperature-sensitive circuit element which, at an elevated temperature, inhibits the igniting function of the starter, the control circuit further comprising an auxiliary switch connected to the temperature-sensitive circuit element and a threshold voltage element coupled to the input terminals, the auxiliary switch being controlled by the threshold voltage element so that the auxiliary switch is open if the voltage across the threshold voltage element is lower than its threshold voltage.

2. An electronic starter as claimed in claim 1, wherein the auxiliary switch comprises a semiconductor device.

3. An electronic starter as claimed in claim 2, wherein the temperature-sensitive circuit element comprises a resistor having a negative temperature coefficient, a first terminal of the NTC resistor being connected to a first electrode of the semiconductor device and the other terminal of the NTC resistor being connected to a second electrode of the semiconductor device, said semiconductor device being non-conducting when the difference in potential between said electrodes is zero.

4. An electronic starter as claimed in claim 2, wherein the temperature-sensitive circuit element comprises a resistor having a positive temperature coefficient, a first end of the PTC resistor being connected to a first electrode of the semiconductor device and the other end of the PTC resistor being connected to a second electrode of the semiconductor device, said semiconductor device being conductive if the difference in potential between said electrodes is zero.

5. An electronic starter as claimed in claim 2, wherein the semiconductor device comprises a thyristor.

6. An electronic starter as claimed in claim 2, wherein the semiconductor device includes the combination of an npn-transistor and a pnp-transistor wherein the base electrode of each of said transistors is connected to the collector electrode of the other transistor, and the temperature-sensitive element comprises an NTC resistor that interconnects the base and the emitter of the npn-transistor.

7. An electronic starter as claimed in claim 2, wherein the semiconductor device includes the combination of an npn-transistor and a pnp-transistor, the base electrode of each of the transistors being connected to the collector electrode of the other transistor, and the temperature-sensitive element comprises a PTC resistor that interconnects the base and the emitter of the pnp-transistor.

8. An electric circuit comprising a discharge lamp provided with at least two electrodes, and an electronic starter as claimed in claim 2, one input terminal of the starter being connected to one electrode of the lamp and the other input terminal of the starter being connected to the other electrode of the lamp.

9. An electric circuit as claimed in claim 8, wherein the lamp comprises preheatable electrodes.

10. An electronic starter as claimed in claim 1, further comprising a resistor connected in parallel with the circuit comprising the semiconductor switch, and wherein the temperature-sensitive circuit element is thermally coupled to said resistor.

11. An electronic starter as claimed in claim 1, wherein the threshold voltage element comprises a zener diode.

12. An electronic starter as claimed in claim 1, wherein the temperature sensitive circuit element is thermally coupled to an inductance element connected in series with the controlled semiconductor switch.

13. An electronic starter as claimed in claim 1, further comprising a diode bridge interconnected between said two input terminals and said controlled semiconductor switch thereby to supply an operating voltage to said semiconductor switch during both half cycles of an AC supply voltage coupled to the two input terminals.

14. An electronic starter for igniting an electric discharge lamp comprising, a pair of input terminals for supplying an operating voltage to the electronic starter, a controlled semiconductor switch connected across said input terminals, said semiconductor switch including first and second electrodes that define a current control for the switch, a control circuit coupled between said first and second electrodes for controlling the operation of said semiconductor switch, said control circuit including a temperature-sensitive element, a voltage threshold element and an auxiliary switch having control electrode means, means coupling the auxiliary switch to at least one of said first and second electrodes of the semiconductor switch so as to control the operating condition of the semiconductor switch, means including said threshold element for coupling the control electrode means of the auxiliary switch to one of said input terminals so that the operating condition of the auxiliary switch is determined by the voltage level of said one input terminal, and means connecting the temperature-sensitive element to the control electrode means of the auxiliary switch thereby to effectively inhibit the operation of the auxiliary switch and thereby the operation of said semiconductor switch when the temperature of the temperature-sensitive element exceeds a given temperature level.

15. An electronic starter as claimed in claim 14, wherein the control circuit further comprises an electronic energy storage element having a charge circuit including diode means coupled to said input terminals and a discharge circuit that includes the auxiliary switch and at least one of said first and second electrodes of the semiconductor switch, the time constant of the charge circuit and the discharge circuit being short relative to the period of an AC supply voltage for operation of the discharge lamp.

16. An electronic starter as claimed in claim 14, wherein the input terminals are adapted to be connected to the preheatable electrodes of a discharge lamp, and wherein the breakdown voltage of the threshold element is lower than the lamp operating voltage so that no current can flow through the temperature-sensitive element during normal operation of the discharge lamp thereby effectively isolating the temperature-sensitive element from the supply voltage at the input terminals during normal lamp operation.

17. An electronic starter as claimed in claim 14, further comprising an inductance element connected in series with the controlled semiconductor switch across the input terminals, and wherein the temperature-sensitive element is thermally coupled to said inductance element.

18. A supply circuit for an electric discharge lamp having two preheatable electrodes comprising, a pair of supply terminals for connection to a source of AC supply voltage, a ballast impedance, means connecting the ballast impedance and the discharge lamp in series across the pair of supply terminals, and an electronic starter as claimed in claim 14 having its pair of input terminals connected to the ends of the lamp electrodes that are remote from the supply terminals.

19. A supply circuit as claimed in claim 18, wherein the breakdown voltage of the threshold element is related to the operating voltage of the discharge lamp in a predetermined ratio, and the electronic starter further comprises a diode bridge interconnected between said two input terminals and said controlled semiconductor switch thereby to supply a DC operating voltage to said semiconductor switch and a preheat current for the lamp electrodes flows through the semiconductor switch during both half cycles of an AC supply voltage applied to said pair of supply terminals during the lamp ignition period.

* * * * *